US006780117B1

(12) United States Patent
Osborne

(10) Patent No.: US 6,780,117 B1
(45) Date of Patent: Aug. 24, 2004

(54) GAME APPARATUS FOR USE WITH A BILLIARD TABLE

(76) Inventor: David Robert Osborne, 120 Wittenoom Steet, Kalgoorlie, Western Austrilia (AU), 6430

( * ) Notice: Subject to any disclaimer, the term of this patent is extended or adjusted under 35 U.S.C. 154(b) by 0 days.

(21) Appl. No.: 10/009,295

(22) PCT Filed: Apr. 19, 2000

(86) PCT No.: PCT/AU00/00344

§ 371 (c)(1),
(2), (4) Date: Apr. 5, 2002

(87) PCT Pub. No.: WO00/66234

PCT Pub. Date: Nov. 9, 2000

(30) Foreign Application Priority Data

Apr. 29, 1999 (AU) ..... PQ0130
Nov. 1, 1999 (AU) ..... PQ3792

(51) Int. Cl.[7] ..... A63D 15/00; A63D 15/04; A47C 17/62; A63E 9/00; A63B 67/14

(52) U.S. Cl. ..... 473/10; 473/4; 473/14; 273/309; 273/108.1

(58) Field of Search ..... 473/1, 4, 6–10, 473/14, 18, 20, 28, 30, 32, 158, 159, 162, 496; 273/108, 108.1, 108.5, 118, 317, 348, 309

(56) References Cited

U.S. PATENT DOCUMENTS

| | | | | | |
|---|---|---|---|---|---|
| 252,805 | A | * | 1/1882 | Saunders | 473/6 |
| 278,341 | A | * | 5/1883 | Kelly | 473/3 |
| 1,813,116 | A | * | 7/1931 | Clausen | 473/20 |
| 3,591,176 | A | * | 7/1971 | Roth | 473/3 |
| 4,063,728 | A | | 12/1977 | Zemanek | |
| 4,114,876 | A | * | 9/1978 | Maruszak | 273/108.21 |
| 4,201,383 | A | * | 5/1980 | Schaller | 273/108.4 |
| 4,251,072 | A | * | 2/1981 | Anthony | 473/18 |
| 4,874,167 | A | | 10/1989 | Hillard | |
| 4,875,680 | A | | 10/1989 | Gross | |
| 5,092,595 | A | * | 3/1992 | Daravina | 273/108.5 |
| 5,110,127 | A | * | 5/1992 | Potter | 273/317.3 |
| 5,183,254 | A | | 2/1993 | Jones | |
| 5,372,364 | A | * | 12/1994 | Arroyo | 273/108.5 |
| 5,431,397 | A | * | 7/1995 | Eckel et al. | 273/108.1 |
| 5,709,385 | A | * | 1/1998 | Fitzpatrick et al. | 273/317.3 |
| 5,752,886 | A | | 5/1998 | Tien | |
| 6,251,024 | B1 | * | 6/2001 | Summers et al. | 473/49 |

OTHER PUBLICATIONS

The Complete Illustrated Encyclopedia of All The Major Sports of The World; Rule of The Game; Coyright © 1990 by Diagram Visual Information Ltd; editor Sylvia Worth; pp. 140–143 and 156–159.*

* cited by examiner

*Primary Examiner*—Stephen P. Garbe
*Assistant Examiner*—Mitra Aryanpour
(74) *Attorney, Agent, or Firm*—Reising, Ethington, Barnes, Kisselle, P.C.

(57) ABSTRACT

A game apparatus (10) adapted for use in conjunction with a standard billiard table (16), the game apparatus (10) comprising a sheet of flexible material (12) and at least one target apparatus (14), wherein the or each target apparatus (14) is releasably engageable with the sheet of flexible material (12) and is adapted to releasably receive a ball member (not shown), said game apparatus (10) being adapted to enable the playing of the game in which one or more billiard balls interact with the ball member, the target apparatus (14) and the billiard table (16), in particular cushions and pockets thereof.

18 Claims, 3 Drawing Sheets

GAME APPARATUS FOR USE WITH A BILLIARD TABLE

FIELD OF THE INVENTION

The present invention relates to a game apparatus. More particularly, the game apparatus of the present invention allows games simulating traditional games to be played on a standard billiard table.

BACKGROUND ART

The playing of billiard table games is a common recreational past time. However, the cost of billiard tables is appreciable and the number of games that can be played on a standard billiard table limited. It is one object of the present invention to provide a relatively low cost apparatus that greatly increases the number of games playable on a standard billiard table.

Further, football sports of all codes enjoy extremely widespread appeal. Games based on football codes, such as board games and electronic games, enjoy particular popularity. It is a further object of the present invention to provide a game apparatus that enables games simulating football sports to be played on a billiard table.

Throughout this specification, unless the context requires otherwise, the phrases "billiard table" and "billiard ball", or variations such as "billiard tables" or "billiard balls", will be understood to encompass pool or snooker tables and balls.

Throughout the specification, unless the context requires otherwise, the word "comprise" or variations such as "comprises" or "comprising", will be understood to imply the inclusion of a stated integer or group of integers but not the exclusion of any other integer or group of integers.

In accordance with the present invention there is provided a game apparatus adapted for use in conjunction with a standard billiard table having cushions and pockets, the game apparatus characterised by a sheet of flexible material and at least one target apparatus wherein the sheet of flexible material is inscribed with markings which, approximate the markings of a soccer Pitch or a field hockey field, and wherein the at least one target apparatus is adapted to resemble a soccer or field hockey goal, is releasably engageable with the sheet of flexible material and is adapted to releasingly receive a ball member, the at least one target apparatus being provided with a non-return assembly which, in use, prevents a ball member that has entered the target apparatus from spontaneously exiting such, whereby said ball member interacts with the markings of the sheet of flexible material and the cushions and pockets of the billiard table and the at least one target apparatus to mimic or designate features of the game of soccer or field hockey.

Preferably, the sheet of flexible material is dimensioned so as to fully occupy the playing surface of the billiard table, having two elongate edges and two shorter edges.

Preferably, two target apparatus are provided. Each target apparatus may be releasably engageable with the sheet of flexible material at or about each of the two shorter edges thereof.

In one form of the invention, the two target apparatus are provided in the form of goal net apparatus, comprising at least two upright members, a cross bar and a net portion, wherein first ends of the two upright members are linked by the crossbar to form a goal mouth, the net portion extending rearwardly therefrom.

Preferably, the non-return assembly comprises a portion of substantially rigid material, pivotally attached to the goal net apparatus such that the portion of substantially rigid material is able to pivot to allow a billiard ball to enter the goal net apparatus, but cannot pivot to allow the exit of such.

Preferably still, the portion of substantially rigid material is attached to the goal apparatus at or about the junction of the upright members with the crossbar.

In a highly preferred form of the invention, the portion of substantially rigid material is dimensioned so as to occupy the complete width of the goal mouth, and at least that portion of the height of the goal mouth such that a standard sized billiard ball cannot clearly pass beneath the portion of substantially rigid material into the goal net apparatus.

In one form of the invention, the portion of substantially rigid material is maintained at an angle of about 45 degrees to the goalmouth so as not to interfere with a standard sized billiard ball passing slowly through the goalmouth.

Preferably, the goal net apparatus further comprises at least one cushion member, adapted to deflect a standard billiard ball. Preferably still, the goal net apparatus comprises two cushion members, positioned either side of the goalmouth and extending rearwardly therefrom, adjacent to the net portion. In a highly preferred form of the invention, each cushion assembly is curved in such a manner as to deflect a standard billiard ball away from sides of the net portion.

A game apparatus adapted for use in conjunction with a standard billiard table having cushions and pockets, the game apparatus comprising a sheet of flexible material and at least one goal net apparatus wherein the sheet of flexible material is inscribed with markings which approximate the markings of a soccer pitch or a field hockey field, and wherein the at least goal net apparatus is adapted to resemble a soccer or field hockey goal, is releasably engageable with the sheet of flexible material and is adapted to releasably receive a ball member, whereby said ball member interacts with the markings of the sheet of flexible material, the cushions and pockets of the billiard table and the at least one goal net apparatus by way of a set of rules to mimic or designate features of the game of soccer or field hockey and wherein the at least one goal net apparatus comprises at least two upright members, two cushion members, a cross bar and a net portion, wherein first ends of the two upright members are linked by the crossbar to form a goal mouth, the net portion extending rearwardly therefrom, the two cushion members being positioned either side of the goal mouth and extending rearwardly therefrom, adjacent to the net portion thereof and is curved in such a manner as to be capable of deflecting a standard billiard ball away from sides of the net portion.

In any of the above forms of the invention, the sheet of flexible material may, in addition to being inscribed with markings approximating the field, pitch or ground of a particular traditional game, be divided into a plurality of regularly shaped regions.

Preferably, said division occurs by way of variations in tone rather than by way of markings. In a highly preferred form of the invention, the sheet of flexible material is divided in a grid pattern.

In any of the above forms of the invention, the game apparatus may further comprise a referee ball, being a billiard-type ball on which markings corresponding to rulings made by referees in a particular traditional game are provided. In accordance with the present invention, there is further provided a billiard table and game apparatus combination, the game apparatus comprising a sheet of flexible material positioned on the playing surface of the billiard table, and at least one target apparatus, wherein the or each target apparatus is releasably engageable with the sheet of flexible material and is adapted to releasably receive a ball, said apparatus being adapted to enable the playing of a game in which one or more billiard balls interact with the target apparatus and the billiard table, in particular cushions and pockets thereof.

BEST MODE(S) FOR CARRYING OUT THE INVENTION

Figure 1:
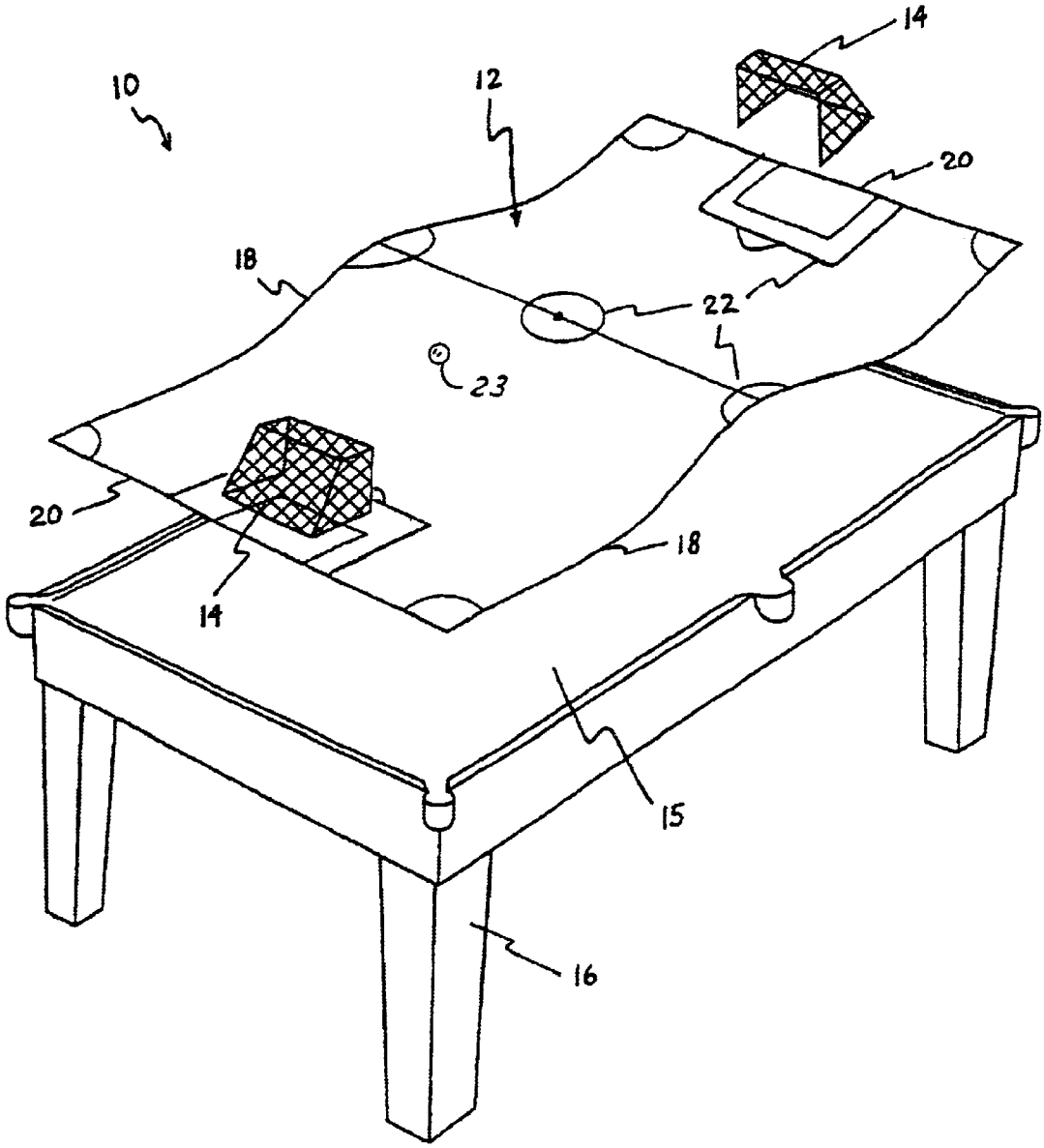
Figure 2:
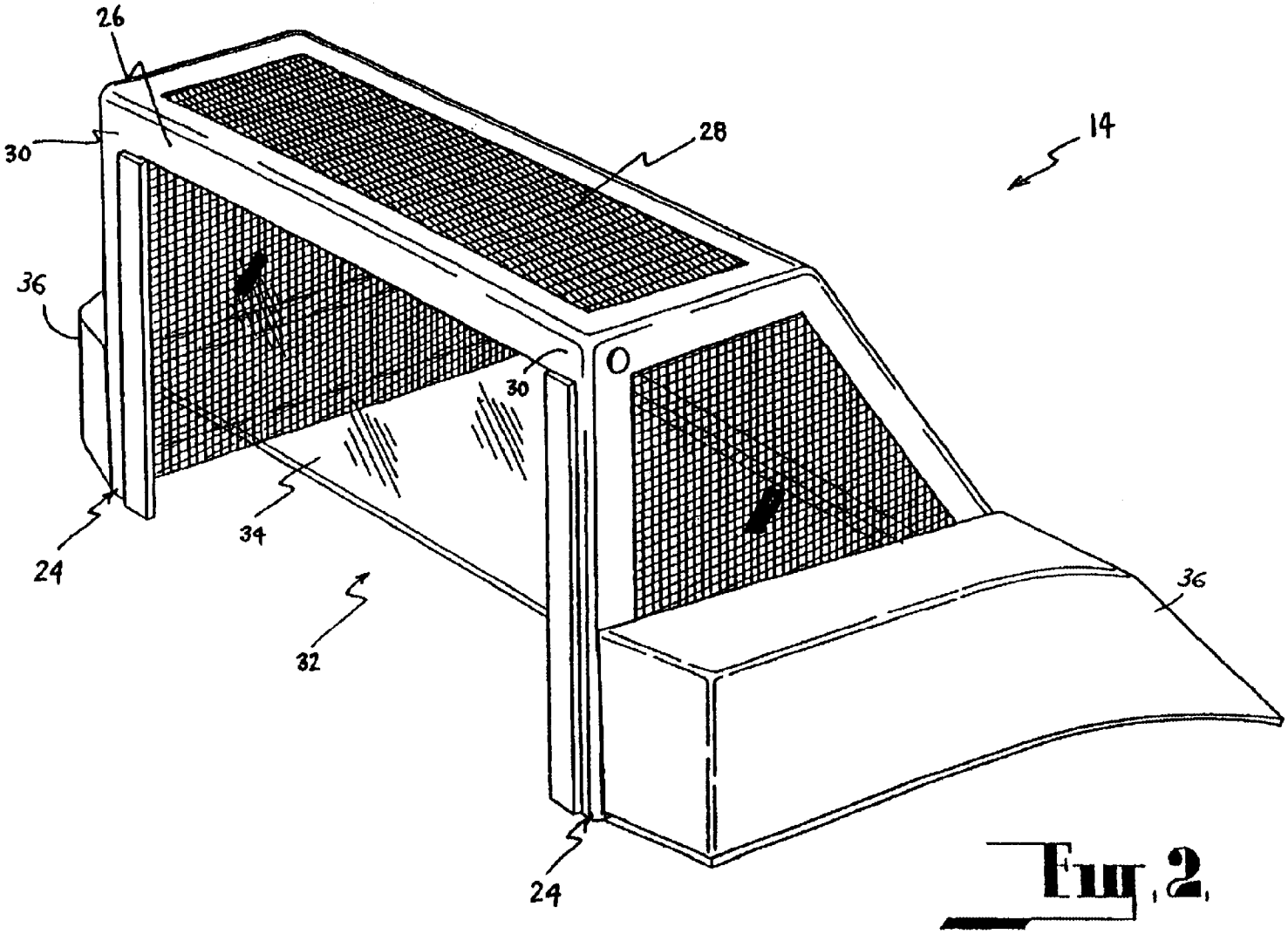
FIG. 2 is a perspective view of the goal net apparatus of FIG. 1, showing in particular a goal mouth and a net portion, a non return means in the form of a portion of substantially rigid material, and two cushion members adapted to deflect a standard billiard ball.

In FIGS. 1 and 2 there is shown a game apparatus 10 in accordance with a first embodiment of the present invention, the game apparatus 10 comprising a sheet of flexible material 12 and two target apparatus in the form of goal net apparatus 14.

The sheet of flexible material 12 is dimensioned so as to occupy the playing surface 15 of a billiard table 16, having two elongate edges 18 and two shorter edges 20, and is inscribed with markings 22 resembling those of a standard soccer pitch.

The goal net apparatus 14 are adapted to receive a standard sized billiard ball 23, and in turn each comprise two upright members 24, a cross bar 26 and a net portion 28. First ends 30 of the upright members 24 are joined by the crossbar 26 to form a goalmouth 32, with the net portion 28 extending rearwardly therefrom, as can best be seen in FIG. 2.

Each goal net apparatus 14 further comprises a non-return means, adapted to prevent a billiard ball 23 that has entered the goal net apparatus 14 by way of the goalmouth 32 from exiting such, in the form of a portion of substantially rigid material 34. The portion of substantially rigid material 34 is pivotally attached to the goal net apparatus at or about the junction of the upright members 24 with the cross bar 26. The portion of substantially rigid material 34 is able to pivot rearwardly to allow a billiard ball 23 to enter the goal net apparatus, but is prevented, by the upright members 24, from pivoting to allow the billiard ball 23 to exit. The portion of substantially rigid material 34 is dimensioned so as to completely occupy the width of the goalmouth 32, and occupies a sufficient portion of the height of the goalmouth 32 such that a billiard ball 23 cannot freely travel thereunder.

Each goal net apparatus 14 still further comprises two cushion members 36, adapted to deflect a standard billiard ball 23. The cushion members 36 are positioned adjacent the upright members 24 and extend rearwardly therefrom, alongside the net portion 28.

The goal net apparatus 14 are releasably attached to the sheet of flexible material 12 at or about opposing shorter edges 20 thereof, as can best be seen in FIG. 1.

In use, a user (not shown) would lay the sheet of flexible material 12 on the laying surface of a standard billiard table 16, then affix the goal net apparatus 14 hereto, enabling a billiard game based on soccer to be played.

Typically, a target ball (not shown), for example a standard white billiard ball, is placed on the sheet of flexible material 12 with two sets of six team balls (not shown), of similar size and shape to standard billiard balls, one set for each of two players (not shown). Conveniently, the sets of team balls are different colours.

An example of a set of rules by which a billiard game based on soccer, in which the target ball, team balls, goal net apparatus 14, markings 22 on the sheet of flexible material 12 of the game apparatus 10 and the billiard table 16, particularly the cushions and pockets thereof, interact is as follows:

RULE 1—The Field of Play 1.1 The game can be played on any pool, snooker or billiard table.

RULE 2—The purpose of the game 2.1 The purpose of the game is to score as many goals as you can in your opponent's goal within a thirty-minute period.

RULE 3—The winner 3.1 The winner of the game, is the player who scores the most goals in the thirty-minute period.

3.2 If the game is tied at the end of thirty minutes, then normal play will continue for a period of 5 minutes, with the first player to score being the winner.

RULE 4—The target ball/Soccer ball 4.1 The ball used for scoring is a standard white billiard/snooker ball.

RULE 5—Number of team balls per team 5.1 On the large snooker tables the number of team balls per side is ELEVEN. On the smaller tables the number of team balls per side is SIX. The team balls have different coloured uniforms to distinguish the sides.

5.2 The goalkeeper may have a different coloured top to the rest of their team balls.

RULE 6—The number of players.

6.1 Two or more players can play the game.

6.2 The player's use a player ball called a team ball.

RULE 7—The start of Play "Kick Off"

7.1 The soccer ball is placed in the centre of the pitch for the kick off.

7.2 A flip of a coin decides which team will kick off. The winner of the coin toss decides the direction in which they wish to kick and takes the kick off.

7.3 The two "kick off" team balls need to be placed on the half way line, in the kick off circle, to ensure the soccer ball is passed forwards at the start of play. These are the only team balls allowed in the circle at the beginning of the game. The soccer ball must be passed before a shot at goal can be taken.

7.4 Each team ball must be placed in their own half of the field during the start of play. They can be placed in any formation.

7.5 After the first goal is scored, only the soccer ball is replaced on the centre spot.

RULE 8—Play 8.1 Players will play alternately, unless the soccer ball is passed, or if a goal is scored, then the side against whom the goal has been scored will take the next kick off.

RULE 9—Passing the soccer ball.

9.1 A player can pass the soccer ball between separate team balls on their side as many times as they like before a shot at goal is taken. The first team ball of either side struck by the soccer ball, is the side that has the right of possession.

9.2 A pass is denoted as one of your team balls hitting the soccer ball, which then hits another one of your team balls. You can not pass to the same team ball, i.e. have two consecutive hits with the same team ball.

9.3 A pass is deemed to have been unsuccessful, and results in a turn over of possession, if the soccer ball does not hit any team balls.

9.4 It is an acceptable pass if the target ball rebounds off the cushions the goal posts back onto the same ball, or if the team ball rebounds of the cushions onto the soccer ball, after initially hitting the soccer ball.

9.5 The soccer ball must be passed during a goal kick, kick off, throw in.

9.6 If the shot at goal or pass is unsuccessful, then it is your opponents turn. If your team ball fails to hit the soccer ball, it is a turn over of possession.

9.8 If you knock one of your team balls into anyone of the pockets, the fallen team ball will stay out of play.

9.9 If you hit the soccer ball during your possession and the soccer ball knocks one of your opponents team balls in a pocket or the goal, your opponents' team ball is lost to the game.

9.10 A player must have at least one foot on the floor whilst playing the game, or it will result in a turn over of possession.

RULE 10—Scoring 10.1 A goal is scored when the soccer ball completely crosses the white goal line.

10.2 A goal can be scored by a clean hit of the soccer ball into the goal, by rebounding off a team ball on either team, or off a cushion.

10.3 The goal is like a pocket. If one of your team balls is knocked into your goal, by the soccer ball, or as a result of rebounding off the soccer ball during an attempt by the other team to score, your team ball is lost to the game and deposited in a pocket. This includes your goalkeeper. Depositing your team ball in a pocket must be undertaken straight away.

10.4 If an opposing player, misses the soccer ball and hits your team ball, and knocks your team ball into the goal, then it is a turn over of possession.

10.5 One goal equals one point.

RULE 11—Goal kick 11.1 Goal kicks are awarded when your opponent knocks the soccer ball into one of the corner pockets at the same end as your goal, or off the end of the table.

11.2 If your opponent passes the soccer ball, and the soccer ball then hits an opponents team ball and falls into an end pocket, the first team ball hit, that is, your opponents team ball, is considered to have caused the loss of the soccer ball to the table.

11.3 A goal kick is taken from anywhere in the Goal Square, but on the same side that the soccer ball left play.

11.4 The opponents team balls can remain in the goal area when a goal kick is about to be taken.

11.5 You can not score directly from a goal kick. An attempt to do so will result in the turn over of possession.

11.6 The goalkeeper or a team ball from your side that is closest to the soccer ball can take a goal kick. When taking the goal kick, the soccer ball is picked up by hand and placed in position in the goal area. The goalkeeper or closest player is also picked up by hand and placed behind the soccer ball to proceed with the kick.

RULE 12—Re positioning the defence 12.1 At the beginning of your turn you can choose to reposition one of the following team balls, either team ball number 1, number 2 or number 3. The re positioning action is a one off optional action at the beginning of your play, it does not affect your turn. Re positioning means to replace players back into your own half using the cue.

12.2 You can re position your goalkeeper, team ball number 1, in the goal area by using a cue, wherever they are on the pitch.

12.3 The team ball number 2, or team ball number 3, can be re positioned if they leave his or her own half. If the re positioning move is unsuccessful in returning either ball number 2 or 3 to its respective half, the re positioning move has still been played, the player is not penalised, they continue with their normal course of play.

12.4 You must state you are taking a re positioning shot when undertaking re positioning.

12.5 If during the re positioning you knock one of your team balls into the goal or a pocket, you loose the team ball that has been pocketed, and it is a turn over of possession.

12.6 If you hit one of your own team balls during the re positioning, it is a turn over of possession.

12.7 If you hit one of your opponent's team balls during the re positioning, it is a turn over of possession.

12.8 If you hit one of your team balls numbered 4–11 in an attempt to reposition them on the pitch, choose not to take your turn, fail to hit the target ball, or take over 60 seconds to play your shot, it is a turn over of possession.

RULE 13—Throw ins 13.1 If you knock the soccer ball into a central side pocket, or over the side of the table it is your opponents 'throw in'. A throw in is an indirect free kick taken from anywhere in the side pocket semi circle lines, which are located around the pocket. You must pass the soccer ball using your closest team ball.

13.2 When taking the throw in, the soccer ball is picked up by hand and placed in position in the throw in semi circle lines. The closest player is also picked up by hand and placed behind the soccer ball to proceed with the kick.

RULE 14—Corners 14.1 If you knock the soccer ball out of play in your own half, that is over the side or into your ends pockets, it is your opponents' corner kick.

14.2 You can score directly from a corner kick.

14.3 The corner is taken with your closest player.

14.4 When taking the corner, the soccer ball is picked up by hand and placed in position in the corner semi circle lines. The closest player is also picked up by hand and placed behind the soccer ball to proceed with the kick.

RULE 15—The goalkeeper 15.1 The game is played with a team ball, goalkeeper, (player number one), placed in the goal area.

15.2 If the goalkeeper is knocked into his/her own goal or any other pocket during an attempt on Goal, or during the course of play, they are lost to the game.

15.3 The goalkeeper can play anywhere on the pitch.

RULE 16—Foul Shot 16.1 A foul shot made by yourself in your own penalty area will result in a penalty.

16.2 If you miss the soccer ball and hit an opponent's team ball with your team ball or the cue, it is a turn over of possession.

16.3 If a player's clothing or body should touch any team ball or target ball it will result in a turn over of possession.

16.4 Striking the team ball with any part of the cue other than the tip will result in it being the opponents turn.

16.5 A push stroke will result in a turn over of possession being awarded. A push stroke is defined as when the tip of the cue remains in contact with the team ball once it has commenced its forward motion.

RULE 17—A Penalty 17.1 The penalty area on a large table is a rectangular box 700 mm×450 mm. It encloses the goal area, and it is identified by a white line 5 mm wide. On a smaller table the penalty area is 350 mm×225 mm.

17.2 A penalty is a foul shot made by you in your own penalty area.

17.3 A penalty is taken from the penalty spot. The soccer ball is placed by hand on the penalty spot, and the striker is anyone of your team balls still on the table. They are not moved to take the penalty, they play the shot from where they are on the pitch.

Penalty infringements inside the penalty area:

Missing the soccer ball and hitting an opponent's team ball. This includes the re positioning play.

If a player's clothing or body should touch any team ball.

Striking the team ball with any part of the cue other than the tip.

A push stroke. A push stroke is defined as when the tip of the cue remains in contact with the team ball once it has commenced its forward motion.

RULE 18—Loss of a player 18.1 During the course of play, if you knock your own team balls into one of the pockets, into your own goal, or off the pitch, you will lose that team ball for the duration of the game.

18.2 During the course of play, if you knock one of the opponent's team balls into one of the pockets, or into a goal, or off the pitch, without hitting the soccer ball first, it will be a turn over of possession. The pocketed team ball is still lost to the game.

RULE 19—Loss of the Game 19.1 A player who clearly fails to make an attempt to shoot or pass in the proscribed manner.

19.2 A player who seeks to gain advantage by deliberately touching a moving ball.

19.3 A player who knowingly breaks the rules of the game.

RULE 20—The cue 20.1 The cue shall not be less than 910 mm in length and shall show no substantial departure from the traditional and generally accepted shape and form.

20.2"Rests" may be used to provide a bridge for the cue.

The game apparatus 10 may further comprise a referee ball (not shown). The referee ball is a standard billiard ball inscribed with the following markings: OFF, YELLOW CARD, LOSS OF POSSESSION, FREE PLAY.

Typically, the referee ball is initially placed on the sheet of flexible material. If a team ball or a target ball hits the referee ball, then the team ball that struck the referees ball will be subject to the ruling which corresponds to the markings appearing uppermost thereon. The referee ball is not moved from its new location.

Figure 3:
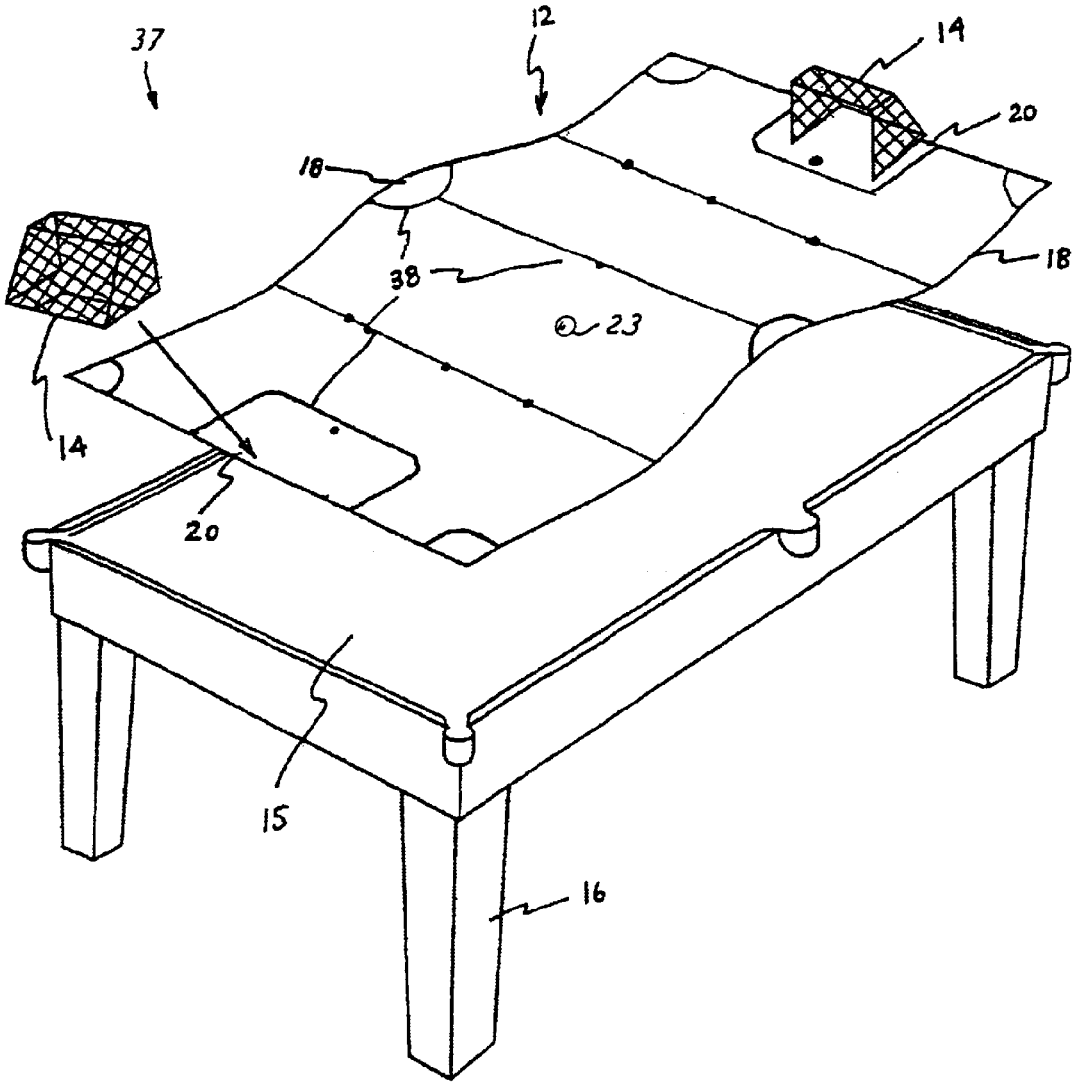
FIG. 3 is a perspective view of a game apparatus in accordance with a second embodiment of the present invention.

In FIG. 3 there is shown a game apparatus 37 in accordance with a second embodiment of the present invention. The game apparatus 37 is substantially identical to the game apparatus 10, and like numerals designate like parts.

However, the sheet of flexible material 12 is inscribed with markings 38 resembling those of a standard field hockey field.

In use, the game apparatus 37 is similar to the game apparatus 10. However, an example set of rules by which a billiard game based on field hockey can be played differs to the rules described for the game apparatus 10, in the following respects:

RULE 5—Number of team balls per team 5.1 On the large snooker tables the number of team balls per side is ELEVEN. On the smaller tables the number of team balls per side is SIX. The team balls have different coloured uniforms to distinguish the sides.

RULE 7—The start of Play "Centre Pass"

7.3 One team ball needs to be placed on the half way line, to ensure the target ball is passed backwards into their own half at the start of play. All the other teams balls must be situated at least ten centimetres away from the target ball at the start of play. The target ball must be passed before a shot at goal can be taken.

RULE 11—Free Hit 11.1 A free hit is awarded for fouls committed outside the shooting circle or PLAY ON can be played.

11.2 A free hit is taken from the nearest free hit spot that is marked on the 25-yard line.

11.3 When taking the free hit, the Hockey ball is picked up by hand and placed in position. No other team ball is moved by hand to establish the shot. Players must take the free shot using team balls in their current positions.

RULE 12—Penalty Corner 12.1 A penalty corner is awarded when the defending team knocks the Hockey ball either into an end pocket or over the end cushion, at the end they are defending.

12.2 A penalty corner is an indirect free strike taken from anywhere in the end pocket semi circle lines, which are located around the pocket. The pocket chosen for this corner is the nearest pocket to where the incident took place. The Hockey ball must be passed using your closest team ball.

12.3 When taking the penalty corner, the Hockey ball is picked up by hand and placed in position in the throw in semi circle lines. The closest player is also picked up by hand and placed behind the Hockey ball to proceed with the kick.

RULE 13—Penalty Strikes 13.1 A penalty strike is awarded when the defence commits a foul inside the shooting circle.

13.2 A penalty strike in is a direct free strike taken from the penalty point in the shooting circle.

13.3 When taking the penalty strike, the Hockey ball is picked up by hand and placed in position. No other team ball is moved by hand to establish the shot. Players must take the penalty using team balls in their current positions.

RULE 17—Foul Shot 17.1 A foul shot will result in a turn over of possession and either the choice of playing on or taking a Free Hit, rule 11, or Penalty Stroke rule 13, depending on where the foul shot occurred.

It is envisaged that the sheet of flexible material 12 may be manufactured in sizes to suit standard billiard tables.

What is claimed is:

1. A game apparatus adapted for use in conjunction with a standard billiard table having cushions and pockets, the game apparatus comprising a sheet of flexible material and at least one target apparatus wherein the sheet of flexible material is inscribed with markings which approximate the markings of a soccer pitch or a field hockey field, and wherein the at least one target apparatus is adapted to resemble a soccer or field hockey goal, is releasably engageable with the sheet of flexible material and is adapted to releasably receive a ball member, the at least one target apparatus being provided with a non-return assembly which, in use, prevents a ball member that has entered the target apparatus from spontaneously exiting such, whereby said ball member interacts with the markings of the sheet of flexible material, the cushions and pockets of the billiard table and the at least one target apparatus to mimic or designate features of the game of soccer or field hockey.

2. A game apparatus according to claim 1 wherein the game apparatus comprises two target apparatus, each target apparatus being provided in the form of goal net apparatus, comprising at least two upright members, a cross bar and a net portion, wherein first ends of the two upright members are linked by the crossbar to form a goal mouth, the net portion extending rearwardly therefrom.

3. A game apparatus according to claim 2 wherein the non-return assembly comprises a sheet of substantially rigid material, pivotally attached to the goal net apparatus such that the portion of substantially rigid material is able to pivot to allow a billiard ball to enter the goal net apparatus, but cannot pivot to allow the exit of such.

4. A game apparatus according to claim 2 wherein the non-return assembly comprises a sheet of substantially rigid material, pivotally attached to the goal net apparatus such that the portion of substantially rigid material is able to pivot to allow a billiard ball to enter the goal net apparatus, but cannot pivot to allow the exit of such, the portion of substantially rigid material being dimensioned so as to occupy the complete width of the goal mouth, and at least that portion of the height of the goal mouth such that a standard sized billiard ball cannot clearly pass beneath the portion of substantially rigid material into the goal net apparatus.

5. A game apparatus according to claim 2 wherein the non-return assembly comprises a sheet of substantially rigid material, pivotally attached to the goal net apparatus such that the portion of substantially rigid material is able to pivot to allow a billiard ball to enter the goal net apparatus, but cannot pivot to allow the exit of such, the portion of substantially rigid material being maintained at an angle of about 45° to the goal mouth so as not to interfere with a standard sized billiard ball passing slowly through the goal mouth.

6. A game apparatus according to claim 2 wherein the goal net apparatus comprises at least one cushion member adapted to deflect a standard billiard ball.

7. A game apparatus according to claim 2 wherein the goal net apparatus comprises two cushion members, the two cushion members being positioned either side of the goal mouth and extending rearwardly therefrom, adjacent to the net portion thereof.

8. A game apparatus according to claim 2 wherein the goal net apparatus, comprises two cushion members, the two cushion members being positioned either side of the goal mouth and extending rearwardly therefrom, adjacent to the net portion thereof and being is curved in such a manner as to be capable of deflecting a standard billiard ball away from sides of the net portion.

9. A game apparatus according to claim 1 characterised in that the sheet of flexible material is, in addition to being inscribed with markings approximating the field, pitch or ground of a particular traditional game, divided into a plurality of regularly shaped regions.

10. A game apparatus according to claim 9 characterised in that said division occurs by way of variations in tone rather than by way of markings.

11. A game apparatus according to either claim 9 characterised in that the sheet of flexible material is divided in a grid pattern.

12. A game apparatus according to claim 1 characterised in that the game apparatus may further comprise a referee ball, being a billiard-type ball on which markings corresponding to rulings made by referees in a particular traditional game are provided.

13. A billiard table and game apparatus combination, the game apparatus comprising a sheet of flexible material inscribed with markings which approximate the markings on a soccer pitch of a field hockey field positioned on the playing surface of the billiard table, and at least one target apparatus adapted to resemble a soccer or field hockey goal, wherein the at least one target apparatus is releasably engageable with the sheet of flexible material and is adapted to releasably receive a ball member, the at least one target apparatus being provided with a non-return assembly which, in use, prevents a ball member that has entered the target apparatus from spontaneously exiting such, said game apparatus being adapted to enable the playing of a game in which the ball member interacts with the target apparatus and the billiard table, in particular cushions and pockets thereof.

14. A game apparatus adapted for use in conjunction with a standard billiard table having cushions and pockets, the game apparatus comprising a sheet of flexible material and at least one goal net apparatus wherein the sheet of flexible material is inscribed with markings which approximate the markings of a soccer pitch or a field hockey field, and wherein the at least goal net apparatus is adapted to resemble a soccer or field hockey goal, is releasably engageable with the sheet of flexible material and is adapted to releasably receive a ball member, whereby said ball member interacts with the markings of the sheet of flexible material, the cushions and pockets of the billiard tableland the at least one goal net apparatus by way of a set of rules to mimic or designate features of the game of soccer or field hockey and wherein the at least one goal net apparatus comprises at least two upright members, two cushion members, a cross bar and a net portion, wherein first ends of the two upright members are linked by the crossbar to form a goal mouth, the net portion extending rearwardly therefrom, the two cushion members being positioned either side of the goal mouth and extending rearwardly therefrom, adjacent to the net portion thereof and is curved in such a manner as to be capable of deflecting a standard billiard ball away from sides of the net portion.

15. A game apparatus according to claim 14 characterised in that the sheet of flexible material is, in addition to being inscribed with markings approximating the field, pitch or ground of a particular traditional game, divided into a plurality of regularly shaped regions.

16. A game apparatus according to claim 15 characterised in that said division occurs by way of variations in tone rather than by way of markings.

17. A game apparatus according to claim 15 characterised in that the sheet of flexible material is divided in a grid pattern.

18. A game apparatus according to claim 14 characterised in that the game apparatus may further comprise a referee ball, being a billiard-type ball on which markings corresponding to rulings made by referees in a particular traditional game are provided.

* * * * *

UNITED STATES PATENT AND TRADEMARK OFFICE

CERTIFICATE OF CORRECTION

PATENT NO. : 6,780,117 B1
DATED : August 24, 2004
INVENTOR(S) : David Robert Osborne It is certified that error appears in the above-identified patent and that said Letters Patent is hereby corrected as shown below:

Title page,
Item [75], Inventor, after "Western" delete "Austrilia" insert -- Australia --

Column 3,
Line 9, after "Brief description of the drawings" insert -- Figure 1 is a perspective view of a game apparatus in accordance with a first embodiment of the present invention, showing in particular a sheet of flexible material inscribed with markings, and two target assemblies in the form of goal net apparatus, adapted to be releasably attached thereto. --
Line 63, after "Material 12 on the" delete "laying" insert -- playing --

Column 9,
Line 57, after "being" delete "is"

Column 10,
Line 1, after "according to" delete "either"
Line 37, after "billiard" delete "tableland" insert -- table and --

Signed and Sealed this

Twenty-fifth Day of January, 2005

JON W. DUDAS
*Director of the United States Patent and Trademark Office*